United States Patent [19]

Campbell

[11] 4,415,076

[45] Nov. 15, 1983

[54] SOFT CONTACT LENS CONTAINER

[76] Inventor: Charles E. Campbell, 2908 Elmwood Ct., Berkeley, Calif. 94705

[21] Appl. No.: 324,301

[22] Filed: Nov. 23, 1981

[51] Int. Cl.[3] ..... A45C 11/04; B08B 3/04

[52] U.S. Cl. ..... 206/5.1; 134/137; 134/201; 206/5.1; 206/205; 220/82 A; 356/124; 356/244; 366/130

[58] Field of Search ..... 206/5.1, 205, 509; 220/82 A, 288; 134/117, 137, 166 R, 182, 183, 201, 113; 366/130; 356/244, 124, 125, 126, 127

[56] References Cited

U.S. PATENT DOCUMENTS

| | | | |
|---|---|---|---|
| 3,072,132 | 1/1963 | Middleton | 134/137 |
| 3,378,020 | 4/1968 | Grabiel | 206/5.1 |
| 3,524,455 | 8/1970 | Hoogesteger et al. | 206/5.1 |

FOREIGN PATENT DOCUMENTS

| | | | |
|---|---|---|---|
| 444535 | 10/1912 | France | 134/137 |
| 189291 | 11/1922 | United Kingdom | 220/288 |

*Primary Examiner*—George E. Lowrance
*Assistant Examiner*—Jimmy G. Foster

[57] ABSTRACT

A soft contact lens container is disclosed for the immersion, preservation, optical measurement, shipping and dispensing of soft contact lenses. The container has an overall cylindrical shape with the cylinder sidewalls divided into mating portions for confining the soft contact lens as well as a liquid saline preservative solution. The cylinder ends are each closed by identical frustrated cones, each cone intruding from the cylinder end and into the cylindrical volume interior of the container. The respective cones from each cylinder end are frustrated by optical flats and confront one another with a small spatial separation so that the soft contact lens is trapped therebetween. Cylinder diameter is chosen to restrict the soft contact lens from passing between the two optical flats of the cone frustrum. In operation, one cylindrical section is filled with soft contact lens saline solution. A soft contact lens is immersed in the solution and the case closed with the remaining and confronting cylindrical lens portion. When equilibrium between the saline solution and soft contact lens is reached, measurement of the lens is made through the optical flats of the container, this measurement being the optical power of the lens or inside curvature of the lens. The container forms a convenient shipping media, minimizes the distorting effect of gravity on the soft contact lens, maintains the required saline solution as well as provides a shockproof environment for lens shipment.

11 Claims, 6 Drawing Figures

SOFT CONTACT LENS CONTAINER

This invention relates to a container for maintaining soft contact lenses in a saline environment while simultaneously permitting testing of the lenses.

STATEMENT OF THE PROBLEM

The measurement of soft contact lens parameters is difficult. These lenses are constructed of a flexible gel material in a hydrated state; change from the hydrated state affects both the power of the lens as well as the negative curvature of the lens where it contacts the eye. Since the contact lens has hydrational dimensional sensitivity in its gel structure to changes in temperature, pH and molarity of the solution in which it is typically immersed, it is hard to get repeatable, clinically significant values for the base curve and power of a soft contact lens.

Typically, such lenses are allowed to come to equilibrium in an aqueous solution, typically a saline solution. By way of example, such a solution is sold under the trademark HYDROCARE, a product of the Allergan Corporation of Irvine, Calif.

Assuming soft contact lenses are immersed in such a saline solution, they become dimensionally stable. It should be noted that the solution neutralizes the force of gravity, gravity being a distorting force on both power and base curve of the soft contact lens. Unfortunately, this equilibrium is reached slowly and so is not compatible with mass production methods.

SUMMARY OF THE PRIOR ART

Heretofore, it has been known to measure power of soft contact lens when immersed in an aqueous solution. Such measurement has occured in containers having an optical window at the top and at the bottom. Alternately, soft contact lens measurement has occurred by temporarily removing the soft contact lens from the saline solution and placing it in a lens holder directly on an instrument for measurement.

Surface curvature measurements have also been made with a soft contact lens immersed in an aqueous solution while in a container. Such containers have at least one optical window through which reflection measurements can be made.

SUMMARY OF THE INVENTION

A soft contact lens container is disclosed for the immersion, preservation, optical measurement, shipping and dispensing of soft contact lenses. Provision is made for air purging of the optical surfaces and trapping of the free air. The container has an overall cylindrical shape with the cylinder sidewalls divided into mating portions for confining the soft contact lens as well as a liquid saline preservative solution. The cylinder ends are each closed by identical frustrated cones, each cone intruding from the cylinder end and into the cylindrical volume interior of the container. The respective cones from each cylinder end are frustrated by optical flats and confront one another with a small spatial separation so that the soft contact lens is trapped therebetween. Cylinder diameter is chosen to restrict the soft contact lens from passing between the two optical flats of the cone frustrum. In operation, one cylindrical section is filled with soft contact lens saline solution. A soft contact lens is immersed in the solution and the case closed with the remaining and confronting cylindrical lens portion. The case is constructed so that air bubbles which are invariably trapped in the case when it is closed automatically move to remote bases of the cones of the case where they cannot interfere with measurement. When equilibrium between the saline solution and soft contact lens is reached, measurement of the lens is made through the optical flats of the container, this measurement being the optical power of the lens or surface curvature of the lens. The construction of the case insures that the lens is held in a centered position with respect to and at a fixed distance from the measuring instrument. The container forms a convenient shipping media, minimizes the distorting effect of gravity on the soft contact lens, maintains the required saline solution as well as provides a shockproof environment for lens shipment.

OBJECTS, FEATURES AND ADVANTAGES

An object of this invention is to disclose a container with integral air traps wherein a contact lens can be placed, maintained in an aqueous solution and measured while in the container for power and base curve. According to this aspect of the invention, at least one cylindric end of the container is closed by a conical structure protruding inwardly of the container. The broad base of the cone and the cylindric sidewalls form a natural air trap. Air entrained on the optical surfaces, and shaken off or removed during container inversion is trapped. Such trapping occurs outside of any optical paths for lens measurement.

The primary advantage of this invention is the almost automatic air purging feature of the case design. Care in purging air is not required in immersing and sealing a lens. Entrained air escapes to and is held between the cylinder side walls and the base of the cones closing the cylinder and of the containers.

An advantage of the disclosed container is that equilibrium of the soft contact lens is achieved while the lens is within the container. It is not required to wait for specific time to pass to allow equilibrium of the soft contact lens gel through hydration to be obtained.

A further advantage of the disclosed container is that it is possible to label the disclosed container with the power of the lens at the production facility. Thereafter, the lens can be shipped, remeasured at the dispensing location and the optical dispenser assured of both power and base curve of the received lens.

Yet another advantage of the labeling of the disclosed container by the manufacturer with the lens shape and its testing in the case by the dispenser is that the credibility of the initial manufacturing specifications can be checked. As contact lenses are oft times dependent in their gel composition upon the degree of hydration, the checking of credibility is especially desirable.

A further advantage of this invention is the container can be made in two parts of an autoclavable optical plastic. The disclosed container can in fact even be used by the customer for the preservation and storage of the lens.

A further object of this invention is to manufacture the optical windows of the case so that the lens is not prevented from being suppoted evenly and in contact with the periphery of the truncated apex of the cone. According to this aspect of the invention, the truncated apex of the cone is manufactured with discrete irregularity about the periphery thereof, these irregularities taking the form of three or more evenly spaced indentations. When the lens is placed in the case over the optical window, the indentations permit a transfer of fluid between the space between the lens and the truncated apex of the cone and rest of the inner volume of the container. This prevents a hydraulic lock or seal to form between the soft lens and the cone.

An advantage of this aspect of the invention is that the soft lens, once in the case, can settle freely until in is completely supported and in contact with the peripery of the truncated apex of the cone. In this way, it is at the known vertex distance so optical measurement within the case can easily occur.

An advantage of this aspect of the invention is that the soft lens, once in the case, cannot be distorted by vacuum drawn between the optical window and the soft lens. Furthermore, and by being maintained in a buoyant support, gravitational warping of the lens does not occur.

Yet another advantage of the invention is that the outside ends of the case are provided with a cylindrical section before the case tapers upwardly and into the two interiorly intruding frustoconical optical surfaces. This outside cylindrical section to the lens provides for convenient centering of the contact lens on measuring equipment.

An additional advantage of this invention is that a soft lens is contained in a minimum of saline solution. The expense of lens confinement in relatively large volumes of saline solution is avoided.

The conical shape intruding from the exterior of the case into the interior thereof includes numerous desirable features. First, it assures that the optical windows are below the air-liquid interface in the interior of the case. Thus, a case liquid interface is all that is seen. Moreover, the spatial area above the optical window becomes a trap for air.

Secondly, and dependent upon how the soft contact lens is inserted within the case, bubbles trapped within the lens itself may easily be purged. Preferably, the case is merely inverted. Air bubbles on the lens rise to the top thereof, pass across the optical flat along the sides of the cone to the air trap area. In the air trap area, they are held well out of the optical path so that a sufficiently good optical surface is maintained for precise measurement.

A further advantage is that the edges of the optical window at the top of the frustrum of the cone provide a ring support of known and fixed diameter and height. The lens is always maintained at a known vertex distance when measured by a lens meter. The casing can even be a reference for sagital measurements, either optically or with ultrasonic devices.

Still another advantage of the conical shape is that a wide unobstructed solid angle for light rays analyzing the contained soft contact lens is provided. The surface curvature measurements can be made with standard ophthalmometers.

Finally, in bringing the optical windows close to the lens, undue lens movement in the container is prevented. The lens is maintained always close to a proper measuring position. The optical thickness of the aqueous portion of the path is minimized by the confronting two cylinders. This minimizes the correction which need be made because of the optical surface between the two windows.

It is yet another object of this invention to construct the case so that the insertion of the lens in the case can be made with the negative surface faced in either direction. Usually when a spherical shell, such as a soft contact lens, is dropped into a fluid bath, hydrodynamic forces make it tend to settle under gravity force with the concave side up. Measurement typically is made with the concave side down. With the design of the case here in hand, it does not matter in which direction the lens is placed within the case. Simple case inversion will provide the correct facing for lens measurement.

It is yet another object of this invention to construct the case so that the soft lens, when in the case and oriented so that the concave surface rests against one of the truncated cones, is prevented from moving sideways so as to slip off the cone. This movement is a de-centering movement and is objectionable as centered measurements are usually desired. To accomplish this object several vertical webs are placed in the area of the container between the cylindrical side wall and the wall of the truncated cone. The top of these webs is below the periphery of the truncated apex of the cone a distance such that the edge of a centered, typically sized soft lens which is resting on the cone nearly touches the web. If the lens then decentered, while resting on the cone, its edge touches a web top lightly prevented further de-centration but not so as to distort the lens or prevent it from primarily resting for support on the cone.

Other objects, features and advantages of this invention will become more apparent after referring to the following specification and attached drawings in which.

Figure 1:
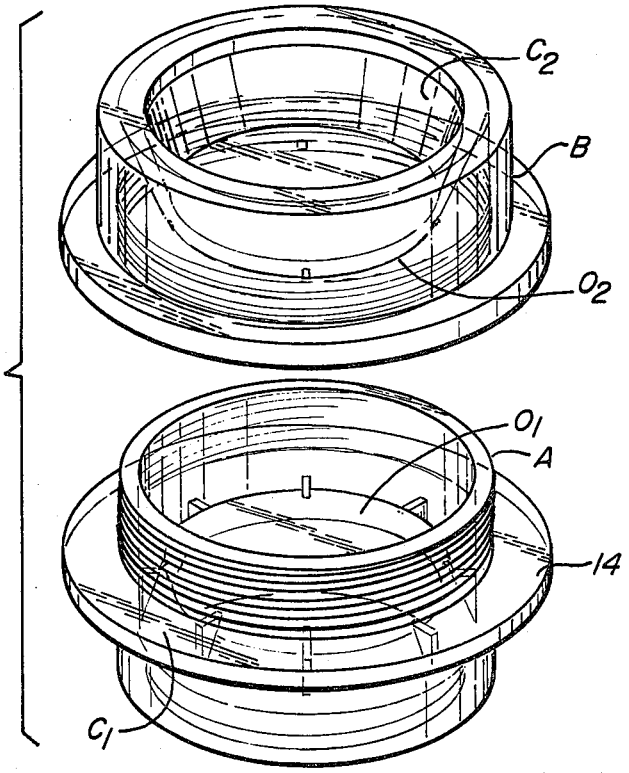
FIG. 1 is an exploded view of the two container sections of the case confronting one another.

Referring to FIG. 1, a preferred embodiment of this invention includes an inside cylindrical housing A and a mating outside cylindrical housing B. Outside cylindrical housing B has an inside diameter configured for a sliding fit over the exterior of outside diameter A onto a rim 14.

Both outside housing A and inside housing B include frustrated cones. A frustrated cone $C_1$ intrudes interiorly of the cylindrical housing A. Similarly, a frustrated cone $C_2$ intrudes interiorly of the cylindrical housing B.

The cones $C_1$ and $C_2$ are each frustrated at an optical flat. Cone $C_1$ is frustrated by optical flat $O_1$; cone $C_2$ is frustrated by optical flat $O_2$. These optical flats are the windows through which the examination of a contained soft lens S (see FIG. 2) can occur.

Figure 2:
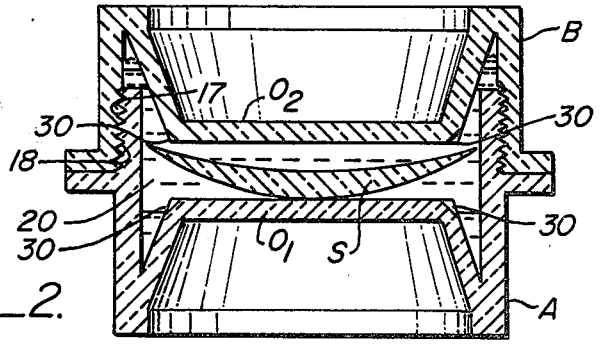
FIG. 2 is a side elevation section showing the container of this invention with a soft contact lens immersed therein.

Referring to FIG. 2, cylindrical housings A and B are shown mated together, with housing A being provided with external male threads 17 and housing B with female threads 18. Typically, housing A is filled with an aqueous saline solution 20 and has soft contact lens S placed therein. Thereafter, housing B is confronted to the saline solution and screwed into place. This will be more particularly illustrated in the cartoon series of FIG. 4.

Figure 3:
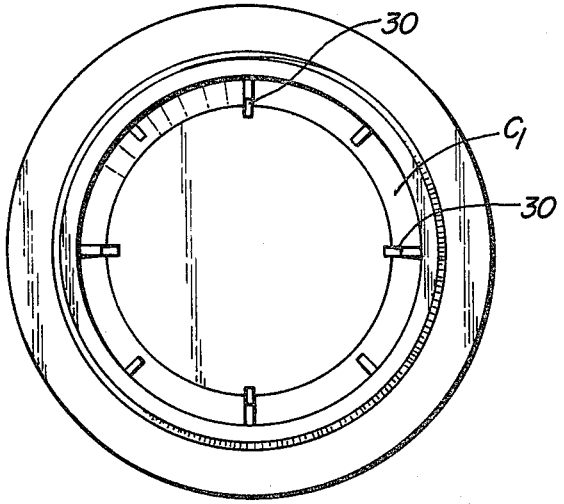
FIG. 3 is a plan view of one of the frustoconical sections of the cones; and, FIGS. 4A, 4B and 4C are a cartoon series of a case first being filled with the fluid and thereafter a lens being inserted being inverted, purged of air and ready for measurement.

Referring to FIG. 3, a plan view of cone $C_1$ is shown. It will be noticed that there are spaced around the periphery of the cone $C_1$ at the point of truncation a group of indentations 30. These indentations shown in side elevation section in FIG. 2 allow circulation between the lens and the optical flat $O_1$ or $O_2$. This prevents any sort of suction or vacuum forming between the optical flat $O_1$ or $O_2$ and the soft contact lens S placed within the casing.

Figure 4A:
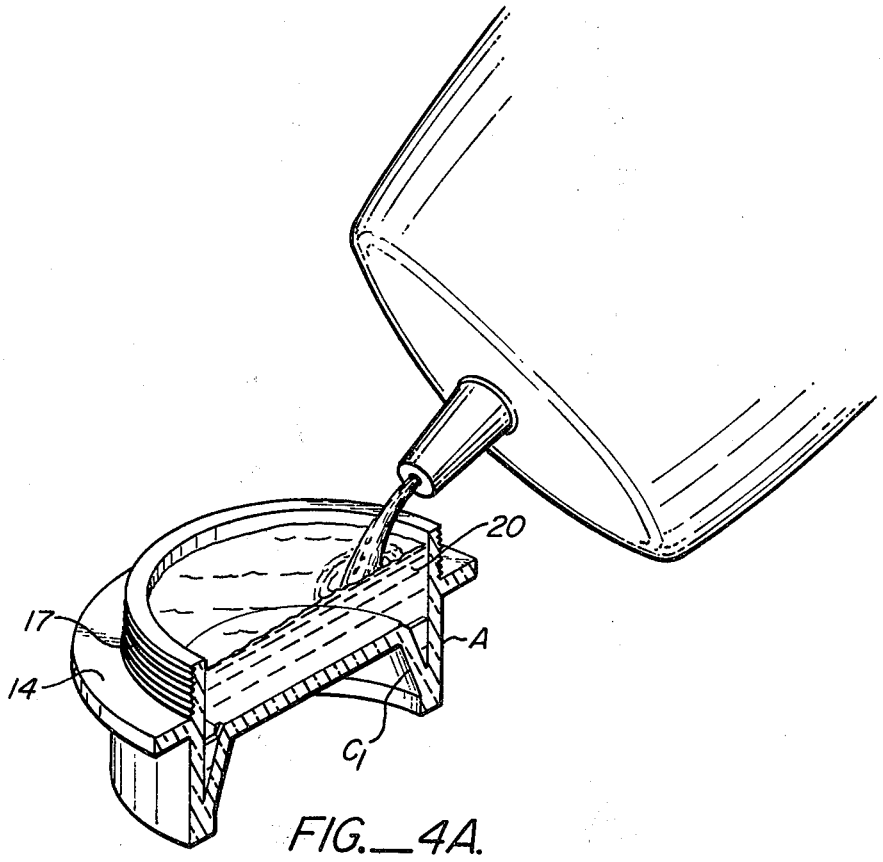

Referring to FIG. 4A, the outside housing A is placed on a flat surface and liquid saline preservative solution added to fill the container above the frustrated portion of cone $C_1$. The aqueous saline solution 20 is illustrated partially filling container A.

Figure 4B:
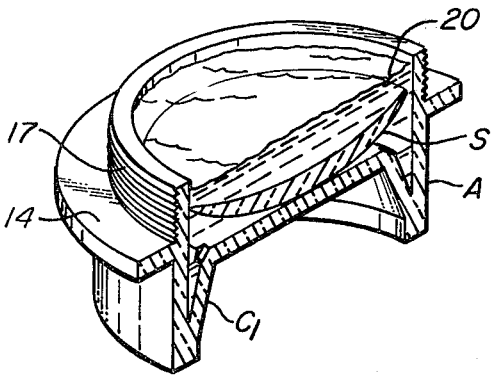

In FIG. 4B, housing A is illustrated with a soft contact lens S placed therein. Here, lens S is illustrated with its concave side upwardly exposed. It should be understood that it almost always occurs that the soft contact lens is exposed with the concave side upwardly when it is placed in the container.

Figure 4C:
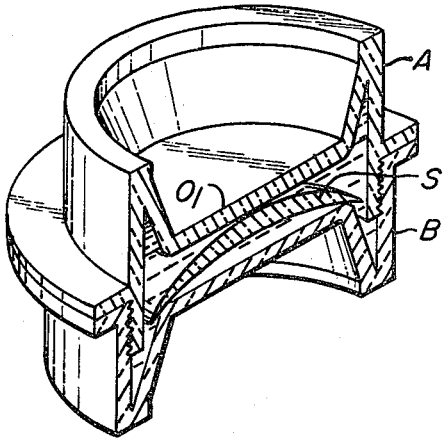

Referring to FIG. 4C, housing A is shown after housing B has been joined thereto. With this configuration, soft contact lens S has its concave side turned upwardly and all air is released from and taken away from the lens surface by floating upwardly. At the same time, the lens goes to the base of the frustoconical indentation where it joins either of the housings A, B. Thus, air is trapped between the sidewalls of the container and the base of the frustoconical indentation outside of any measuring optical path.

It will be noted that the case provides a conical optical path to and from the outside surface of the lens. Measurement can conveniently occur. Naturally, correction for the index of the case saline solution as well as soft contact lens must be made to assure proper output.

I have shown here optical flats for the examination of the lens S. It may well be that lens surfaces could be substituted for the optical flats. This substitution could be made in anticipation of the particular measurement technique to be used on the soft contact lens S.

What is claimed is:

1. A soft contact lens container including in combination:

a fluid tight housing having opposed end walls and at least one side wall for confining there within an aqueous soft lens preservative solution, said side wall having a dimension larger than the diameter of said contact lens for confining side-to-side movement of a soft contact lens placed with said preservative solution interior of said container;

first and second opposed frustoconical indentations intruding interiorly of said container from a base portion of said frustoconical indentations in confronting relationship for confining therebetween a soft contact lens; and optically transparent flat surfaces, in opposing juxtaposed relation to said frustoconical indentations, for providing a view path through said aqueous solution, whereby it is possible to determine both base curve and power of contained soft contact lenses within said container as desired, and whereby air within said container is trapped between the side walls of said housing and the base portion of said frustoconical indentations.

2. The invention of claim 1, wherein said fluid tight housing includes first and second cylindrical portions joined together along a fluid sealed boundary.

3. The invention of claim 2, wherein said optically transparent flat surfaces intrude interiorly of said container and include spaced indented portions peripheral to said transparent means to promote preservative fluid circulation between said frustoconical indentations and said contained soft contact lens.

4. A process of examining a soft contact lens for both base curve and power as desired, comprising the steps of:

providing a fluid tight container having side walls divided into first and second fluid enclosing portions;

configuring end wall portions of said respective fluid tight container with frustoconical intrusions;

providing optically transparent flat surfaces;

filling one of said fluid enclosing portions with a soft lens hydrating solution;

depositing said soft contact lens within said solution;

enclosing said soft lens within said container by confronting the other fluid enclosing portion to said soft contact lens within said container to cause said contact lens to be confined between opposed optically transparent flat surfaces and to trap air between a base portion of the frustoconical intrusions and the side walls of said container; and examining said contained soft contact lens for both base curve and power as desired.

5. The invention of claim 4 including the step of:

inverting said container to cause air trapped within said contact lens to be purged from an interstitial area between said confronted optically transparent flat surface and said soft contact lens.

6. A soft lens and container therefor comprising in combination:

a soft contact lens;

first and second mating cylindrical portions confining said soft contact lens;

said container portions being cylindrical with a diameter exceeding the diameter of said soft contact lens;

each said cylindrical container portion having a closed end with a frustoconical body intruding interiorly of the cylindrical volume formed by said container;

an optical surface in opposing juxtaposed relation to each said frustoconical body;

said optical surface providing a view surface through said container;

said cylindrical container portions confronted one towards another so that an interstitial area defined therebetween, in cooperation with the side walls of said container, confines a contact lens in a known vertex distance relative to said container, the interior of said frustoconical body provides an air trap between cylindrical portions and a base portion of said frustoconical body and the side walls of said container, and the exterior of said frustoconical body provides a view path for examining the optical properties of said soft contact lens.

7. The apparatus of claim 6, wherein said container includes means for providing threaded engagement between the cylindrical container walls.

8. The apparatus of claim 6, wherein an exterior portion of said frustoconical indentation is hollow.

9. The apparatus of claim 6, wherein said optical surface is an optically flat transparent surface.

10. The invention of claim 1, wherein webs extend between the sidewalls of said container and said frustoconical indentations.

11. The apparatus of claim 6, wherein a web extends between said frustoconical body and said cylinder.

* * * * *